United States Patent [19]

Berggren

[11] 4,439,120

[45] Mar. 27, 1984

[54] MESHING COG-WHEEL INJECTION UNIT WITH LATERAL SEALING AND SCROPERS

[75] Inventor: Per-Olov Berggren, Ersmark, Sweden

[73] Assignee: Skega AB, Ersmark, Sweden

[21] Appl. No.: 314,415

[22] Filed: Oct. 23, 1981

[30] Foreign Application Priority Data

Oct. 27, 1980 [SE] Sweden ..... 8007519

[51] Int. Cl.[3] ..... F04C 2/18; F04C 13/00; F04C 15/00

[52] U.S. Cl. ..... 418/77; 418/81; 418/134; 418/144; 418/181; 418/178; 418/206; 15/256.51

[58] Field of Search ..... 418/75, 77, 81, 131, 418/134, 144, 181, 205, 206, 270, 178; 264/37; 425/218, 289, 376 B; 15/256.51

[56] References Cited

U.S. PATENT DOCUMENTS

| | | | |
|---|---|---|---|
| 2,350,089 | 5/1944 | Behringer | 15/256.51 |
| 2,470,355 | 5/1949 | Lauck | 418/81 |
| 3,191,540 | 6/1965 | Skretting | 418/81 |
| 3,759,220 | 9/1973 | Saito et al. | 15/256.51 |
| 4,194,841 | 3/1980 | Tadmor | 425/376 B |

*Primary Examiner*—John J. Vrablik
*Attorney, Agent, or Firm*—Cushman, Darby & Cushman

[57] ABSTRACT

An injection unit intended to inject, for example, rubber into a mold comprises in principle two driven cog-wheels, which are located each in a hollow space in the unit housing and mesh with each other, and which in an injection chamber located in direct connection to the engagement zone of the cog-wheels subjects material fed-in to a high pressure, so that the material is pressed out of the injection chamber to a mold. Due to the high pressure, sealing problems arise which according to this invention are solved in that in the housing of the injection unit plane sealings are provided for co-operation with peripheral side portions of the respective cog-wheel, and that at least in the sides of the cog-wheels or in the surfaces of the plane sealings facing to the cog-wheels grooves extending all about are located radially inside the base circle of the cog-wheels for taking up possible material leaking in between the cog-wheels and the plane sealings, and that in connection to the respective groove, in the rotation direction of the cog-wheels after the injection chamber, means are provided for guiding said material in between the cogs of the cog-wheels and, thus, for returning the material to the injection chamber.

9 Claims, 10 Drawing Figures

MESHING COG-WHEEL INJECTION UNIT WITH LATERAL SEALING AND SCROPERS

Figure 1:
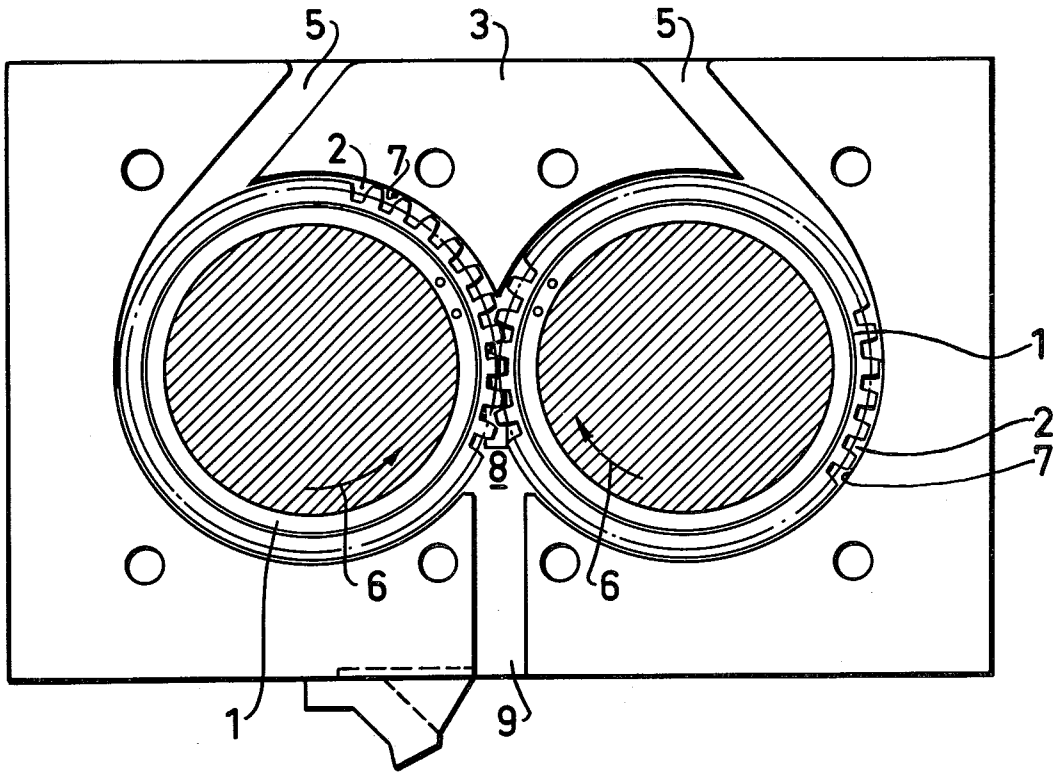

This invention relates to an injection unit, which is intended for injecting rubber or other viscous material into a mold or the like, and which comprises two driven cog-wheels, each located in a hollow space and meshing with each other, which cog-wheels in an injection chamber located in direct connection to the meshing zone of the cog-wheels compress material, which is fed continuously to the injection chamber by the cog-wheels, by the meshing engagement of their cogs and thereby subject the material to a high pressure, so that the material is pressed out of the injection chamber through an injection passageway connected to a mold or the like.

Injection units of the aforesaid type operate in principle like gear pumps and have been sealed in the same way as such pumps. It was found, however, that sealings applied in gear pumps are not sufficiently resistant for being used in such units for injecting rubber under pressure, because of the heat generated in the injection chamber of the unit which causes the rubber to vulcanize. The material obtained has viscous properties entirely different of those of the unvulcanized rubber, which has been fed in, and also of the viscous medium, for example oil, for which gear pumps normally are used. Known sealings have proved not to be capable to resist such material and broke after a relatively short time. Consequently, material can leak into the bearings, which are pitched-up and must be exchanged. The sealing problem has been solved by the present invention.

According to the invention there is provided an apparatus for injecting viscous material including a housing having a cavity therein; two oppositely rotatable driven cog-wheels in the cavity, the cog-wheels having axially projecting journals, the cog-wheels being meshed with each other in an engagement zone and defining with the walls of the cavity a high pressure injection chamber in communication with and at a location just in advance of the engagement zone with respect to the direction of rotation of the cog-wheels; inlet passage means leading to the periphery of the cog-wheels; injection passage means extending from the injection chamber, the arrangement being such that material fed into the inlet passage means travels around part of the peripheries of the cog-wheels to the injection chamber without passing through the engagement zone; sealing means within the casing for cooperation with cylindrical lateral portions of each cog-wheel, at least said cylindrical portions or the surfaces of the sealing means facing said cylindrical portions having annular grooves located radially inwardly of the periphery of the cog-wheels for receiving injection material which might leak between said cog-wheels and the sealing means; guide means in each groove at a location behind the injection chamber with respect to the direction of cog-wheel rotation for directly guiding such material in between the cogs of the cog-wheels at a location in advance of the inlet passage means whereby such material is directly engaged by and carried by the cog-wheels and subsequently returned to the injection chamber.

Figure 2:
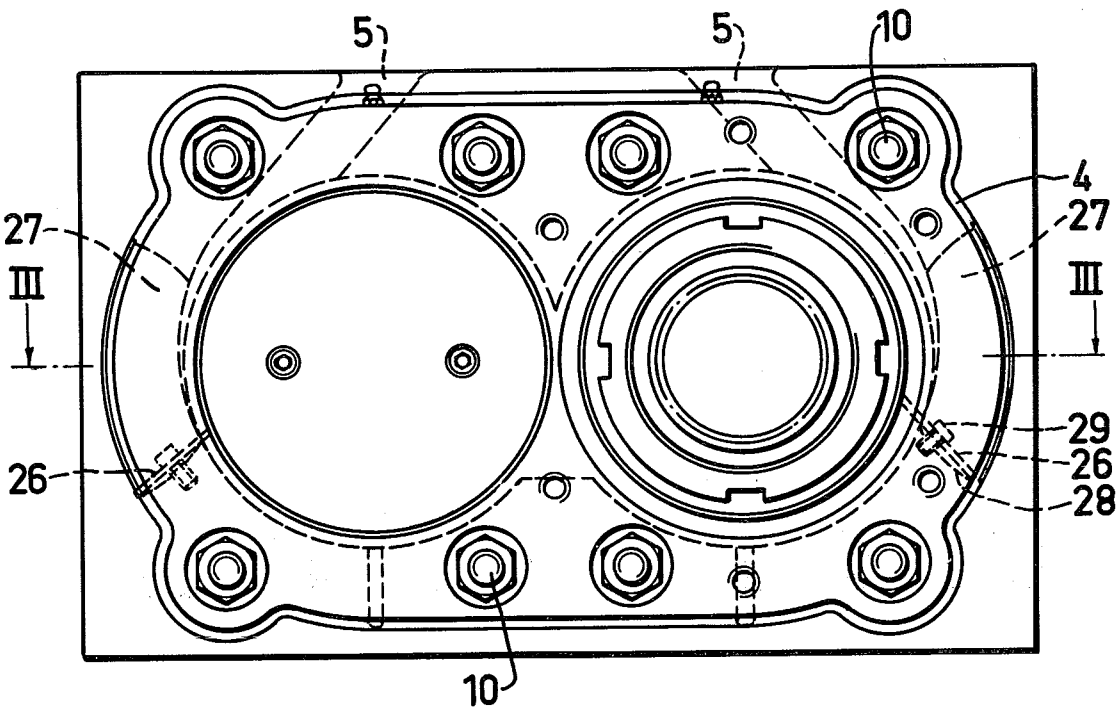
Figure 3:
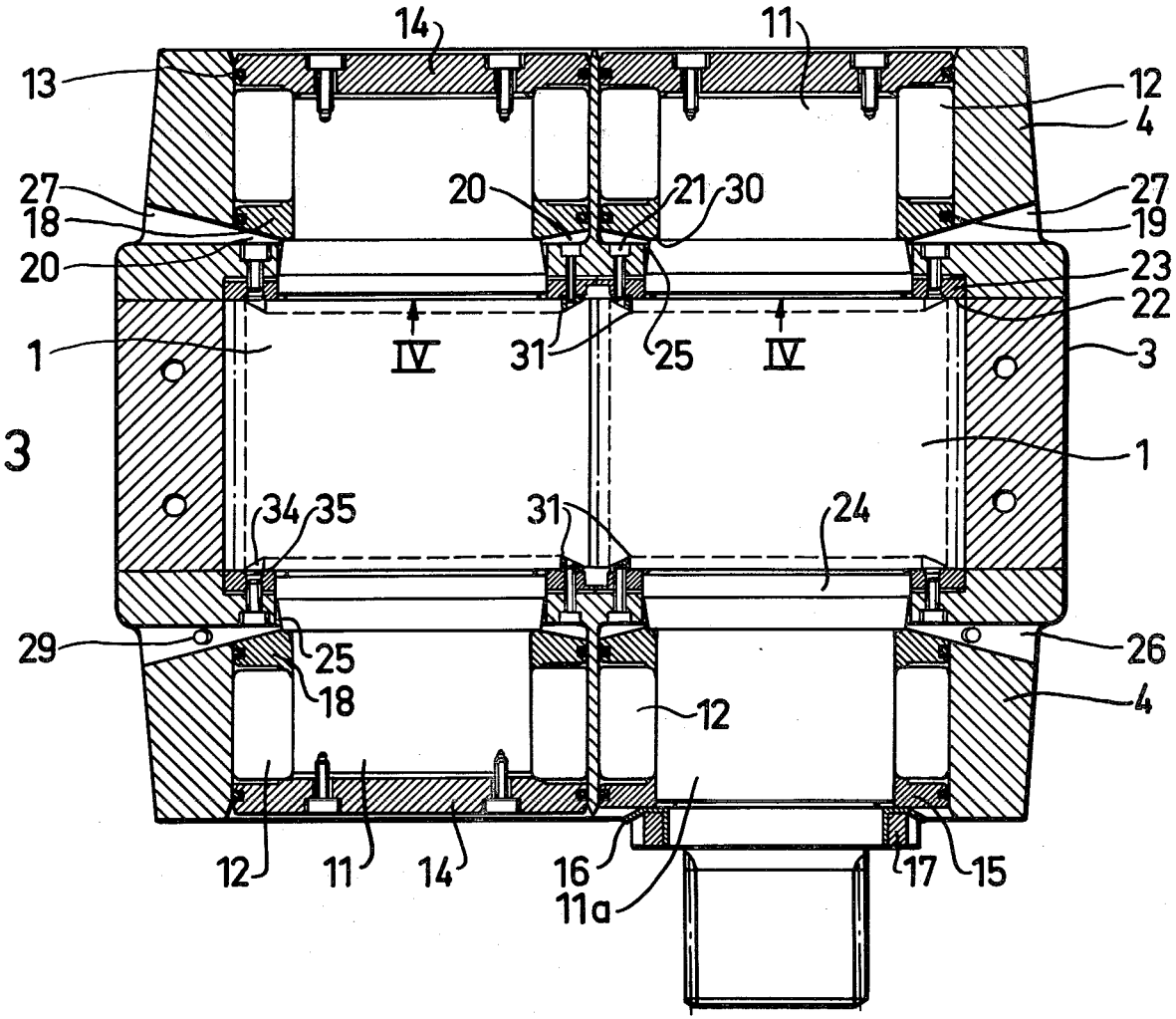
Figure 4:
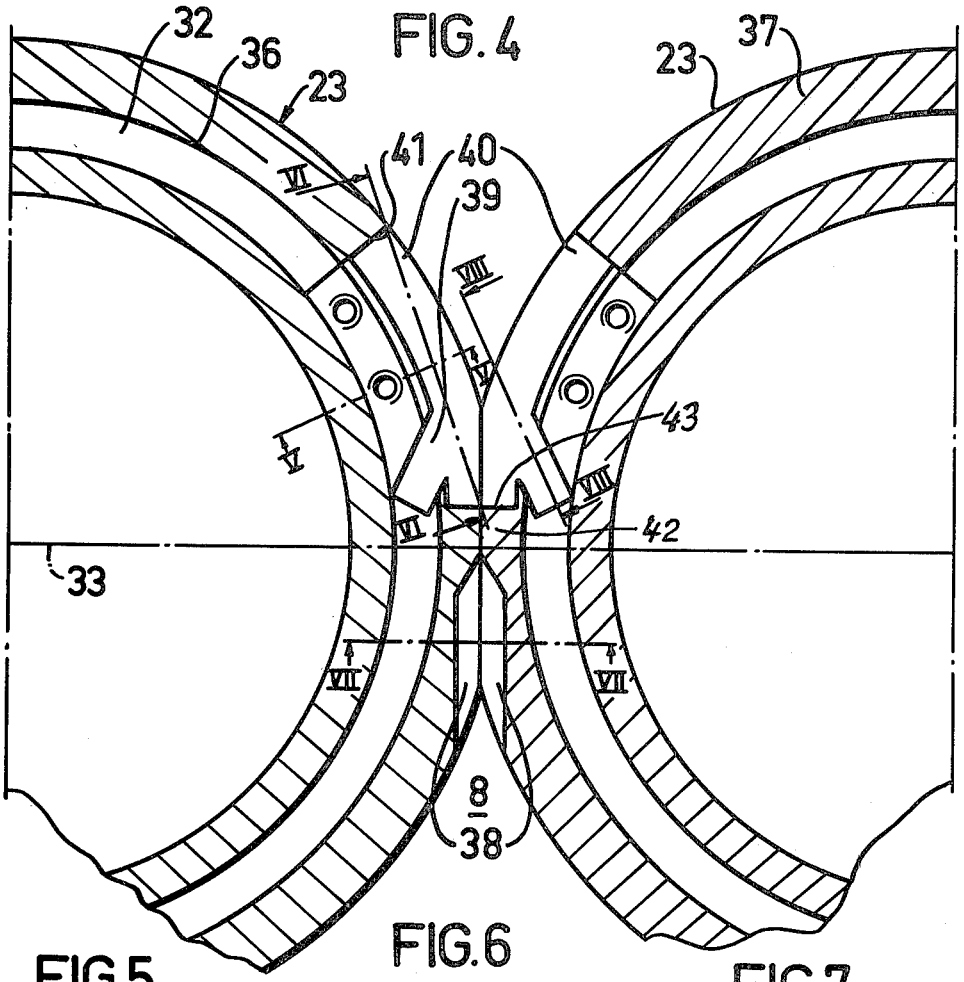
Figure 5:
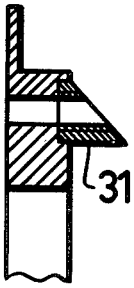
Figure 6:
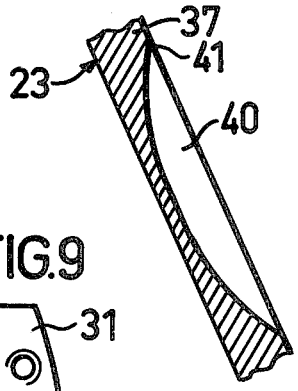
Figure 7:
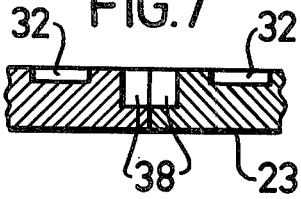
Figure 9:
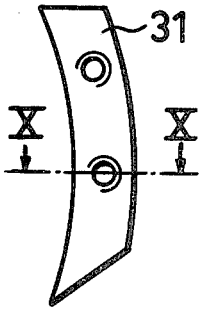
Figure 8:
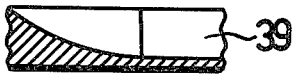
Figure 10:
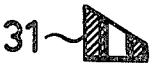

The invention is described in greater detail in the following, with reference to the accompanying drawings, in which FIG. 1 is a schematic section through an injection unit for illustrating the function and internal design of such a unit, FIG. 2 is an end view of such an injection unit according to the invention, FIG. 3 is a section substantially along the line III—III in FIG. 2, FIG. 4 shows two wear rings comprised in the unit, seen substantially along the line IV—IV in FIG. 3, FIG. 5 is a section along the line V—V in FIG. 4, FIG. 6 is a section along the line VI—VI in FIG. 4, FIG. 7 is a section along the line VII—VII in FIG. 4, FIG. 8 is a section along the line VIII—VIII in FIG. 4, FIG. 9 is a plane view of a scraper comprised in the invention, and FIG. 10 is a section along the line X—X in FIG. 9.

The injection unit shown in the drawings and intended for injecting rubber or other viscous material under high pressure into a mold comprises two cog-wheels 1 co-operating with one another in known manner. Each cog-wheel is located in a hollow space 2 in an intermediate piece 3, which together with the end wall pieces 4 forms the housing of the unit. To each of said hollow spaces 2 passageways 5 are connected for continuously feeding rubber of strip-shape to the periphery of the cog-wheels. Rubber fed-in is seized by the cogs of the cog-wheels rotating in the direction marked by the arrows 6 and is pressed into the cog gaps by the peripheral wall 7 of the respective hollow space. Thus, the rubber fed-in is taken along by the respective cog-wheels to an injection chamber 8, which is located in direct connection to the meshing zone of the cog-wheels and is closed by the meshing engagement of the cogs. In said chamber, thus, the rubber is exposed by said engagement to such a high pressure that it is extruded from the injection chamber 8 through an injection passageway 9, which is connected to a mold or the like (not shown).

The cog-wheels 1 with their journals 11, which preferably are designed integral with the respective cog-wheel, are supported in roller bearings 12 in the two end wall pieces 4, which are located each on one side of the intermediate piece 3 and connected thereto by means of through bolts 10 or the like. As a protection and for retaining the roller bearings, bearing caps 14, which are sealed peripherally to the respective end wall piece 4 by means of a sealing ring 13, are screwed on the end of all journals 11, except one which is designated by **11*a* and designed as a drive shaft. Its roller bearing 12 is retained by means of a distance ring 15 and a shaft nut 17, which is located on the drive shaft 11*a* and locked by means of a locking washer 16**.

On the inside of each roller bearing 12 on the respective journal 11, **11*a* a guard ring 18 is mounted, which by means of a peripheral sealing 19 is sealed against the respective end wall piece 4 and which abuts a shoulder 30 on the respective journal 11,11*a*. Each such guard ring 18 is bevel cut on the side facing to the respective end wall piece 4, so that a substantially V-shaped space 20 extending all about is formed between each guard ring 18 and the annular surface 21** of the respective end wall piece.

The said guard rings 18, thus, contribute to fixing the roller bearings 12 on the respective journals **11,11*a*, which are prevented from moving in their longitudinal direction, in that the cog-wheels 1 with their lateral portions 22** located radially outside the journals abut with slip fit the respective end wall piece 4, more precisely the wear rings 23 screwed on the respective end wall piece according to the present invention. Said wear rings enclose a cylindric portion 24 on the respective journal 11,11*a*, from which portion each journal 11,11*a* is designed with clearance, i.e. conically, all the way to the shoulder 30, against which the guard ring 18 abuts, so that an opening 25 is formed which extends to the substantially V-shaped space 20 between the end wall piece and the guard ring 18.

According to the principles on which the present invention is based, the wear ring 23 must not seal against the cylindric portion 24 of the associated journal, because if unexpectedly some material should pass therebetween and possibly between the wear ring 23 and the surface of the end wall piece, against which it is screwed, this material will be directed via the opening 25 into the substantially V-shaped space 20 between the end wall piece and guard ring 18, where the material is taken along by the rotating guard ring 18, from which the material is scraped by a scraper 26, which is located in an opening 27 in the end wall piece 4 which is a direct continuation of the substantially V-shaped space 20 along a portion of the periphery thereof, as appears from FIG. 2. The scraper 26 is key-shaped corresponding to the substantially V-shaped cross-section of the opening 27 and space 20 and extends with its pointed end all the way to and abuts the journal 11,11*a* and tightly seals against the sides of the opening 27 and space. The scraper, as shown in FIG. 2, is attached to the end surface 28 of the opening 27 which, seen in the direction of rotation of the cog-wheel is the remote end surface, by means of a screw 29 or the like. By designing the said end surface arc-shaped in transversal as well as in longitudinal direction, the scraper 26 upon tightening the screw 29 is caused safely to engage with the sides of the opening 27.

In the same way as described above, such a scraper 26 is provided at each journal 11,11*a* for scraping off material, which possibly may have leaked out. The material scraped off is led out by the scraper through the opening 27 where it is collected and removed, possibly recycled into the unit.

According to the present invention, furthermore, in order to prevent to the greatest possible extent such leakage of material, each wear ring 23 on its side facing to the cog-wheel is provided with a scraper 31 designed substantially as shown in FIGS. 9 and 10. The scraper is screwed on the wear ring 23 in a circular groove 32 therein, as shown in FIG. 4. Each scraper 31 is located with its end facing against the rotation direction of the cog-wheel in said direction after the maximum engagement zone of the cog-wheels, i.e. above the centre line 33 in FIG. 4, and extends in transversal direction into a groove 34 formed in the adjacent side of the cog-wheel. Said groove has a cross-sectional profile, which corresponds to the cross-sectional profile of the scraper located outside the wear ring. The groove 34 is located with its point 35 slightly inside of the base circle of the respective cog-wheel, and so is also the groove 32 in each wear ring 23 located with its outer circular defining line 36. The portion 37 of each wear ring located radially outside the groove 32, thus, abuts with slip fit the cogs of the respective cog-wheel and seals against the same.

In the injection chamber 8 the wear rings 23 abutting each other with beveled surfaces on each side of the cog-wheel 1 are provided with relieving grooves 38, which are located below the centre line 33 shown in FIG. 4 through the two cog-wheels 1. Said grooves extend back to the injection chamber 8. Their object is to take up the material, which is pressed out in axial direction from the cog-wheels as the mutual engagement therof increases, and to return this material to the injection chamber 8. Hereby also a pressure relief in the engagement zone of the cogs is obtained.

In spite of said relief grooves 38, owing to the high pressure prevailing in the engagement zone of the cogs material can be pressed radially inward between the cogs and the outer portion 37 of the wear rings. If this occurs, however, this material is collected by the groove 34 in the side of each cog-wheel and taken along finally by the respective cog-wheel 1. Thereby the material following with the cog-wheel will be scraped off from the walls of the groove 34 by the scraper 31 located in the groove 32 of the wear ring in the rotation direction of the cog-wheels after the engagement zone of the cogs. In front of said scraper 31 a depression 39 is located which extends to an arc-shaped depression 40 in the outer portion 37 of the respective wear ring. The material scraped off by the scraper 31, thus, is led via the depression 40, which has decreasing height in the rotation direction of the cog-wheels and ceases entirely at 41. From the depression 40 the material then is taken along by the rotating cog-wheel 1 in its rotation direction and, due to the shape of the depression 40, is introduced into the cog gaps between the cogs of the cog-wheel and thereby is returned to the injection chamber 8.

In the same way is returned to the injection chamber 8 the possible material, which is pressed into the depressions 40 via the surfaces of the outer portions 37 of the wear rings which are designated by 42 in FIG. 4 and located between the relief grooves 38 and depressions 40. The ends 43 of the depressions 40 which in rotation direction of the cog-wheels are the forward ends can be located at a greater distance from the centre line 33 than appearing from FIG. 4, and this applies also to the scrapers 31.

By this arrangement of plane sealing and scrapers according to the invention, the injection unit of the type in question has been given considerably improved reliability of operation and a longer coherent operation time than it heretofore has been the case.

The present invention is not restricted to the embodiment described above and shown in the drawings, but can be altered and modified in many different ways within the scope of the invention idea defined in the attached claims.

What I claim is:

1. Apparatus for injecting viscous material comprising a housing having a cavity therein; two oppositely rotatable driven cog-wheels in the cavity, said cog-wheels having axially projecting journals, said cog-wheels being meshed with each other in an engagement zone and defining with the walls of the cavity a high pressure injection chamber in communication with and at a location just in advance of the engagement zone with respect to the direction of rotation of the cog-wheels; inlet passage means leading to the periphery of the cog-wheels; injection passage means extending from the injection chamber, the arrangement being such that material fed into the inlet passage means travels around part of the peripheries of the cog-wheels to the injection chamber without passing through the engagement zone; sealing means within the casing for cooperation with cylindrical lateral portions of each cog-wheel, at least said cylindrical portions or the surfaces of the sealing means facing said cylindrical portions having annular grooves located radially inwardly of the periphery of the cog-wheels for recieving injection material which might leak between said cog-wheels and said sealing means; guide means in each groove at a location behind the injection chamber with respect to the direction of cog-wheel rotation for directly guiding such material in between the cogs of the cog-wheels at a location in advance of the inlet passage means whereby such material is directly engaged by and carried by the cog-wheels and subsequently returned to the injection chamber.

2. Apparatus as in claim 1 wherein said annular grooves are located between the periphery of the respective cog-wheels and the respective journals.

3. Apparatus as in claim 1 including bearings within said housing for said journals and a relatively narrow gap located radially inwardly of said grooves and between the journal of the respective cog-wheel and said housing, said gap opening into an annular space located axially inward of the bearings, said space at least at one location extending outwards to the outside of the housing for conducting away leaked injection material which is not returned to said injection chamber by said cog-wheels.

4. Apparatus as in claim 3 wherein said annular space is separated from the respective bearing by a guard ring which is located on the journal, rotates with the same and is sealed against the housing.

5. Apparatus as in claim 4 wherein said annular space is substantially V-shaped in cross-section and at the location where it extends outward to the outside of the housing is provided with a scraper sealing against the sides of said space and abutting the side of the guard ring.

6. Apparatus as in claim 1 wherein said guide means includes a scraper attached to said sealing means and operating against the bottom of the respective annular groove, said sealing means having a depression therein located in advance of the scraper with respect to the direction of cog-wheel rotation and extending in an outward direction, said sealing means having a further depression located in its periphery on the same level as the cogs of the respective cog-wheel and extending outward, the height of said further depression decreasing in the direction of cog-wheel rotation for introducing leaked injection material between the cogs of the cog-wheel.

7. Apparatus as in claim 1 wherein there is an annular groove in both said sealing means and in the cylindrical portions of said cog-wheels.

8. Apparatus as in claim 7 wherein each scraper is located in the annular groove in the respective sealing means and extends into the annular groove in the respective cog-wheel.

9. Apparatus as in claim 1 wherein said sealing means include rings of wear-resistant material, each ring surrounding a respective journal without sealing against the same.

* * * * *